US007350680B2

(12) United States Patent
DeBroeck

(10) Patent No.: US 7,350,680 B2
(45) Date of Patent: Apr. 1, 2008

(54) RADIATION GARMENT HOLDER AND METHODS

(76) Inventor: Mark DeBroeck, 1436 Aubree La., Walla Walla, WA (US) 99362

( * ) Notice: Subject to any disclaimer, the term of this patent is extended or adjusted under 35 U.S.C. 154(b) by 130 days.

(21) Appl. No.: 11/068,310

(22) Filed: Feb. 28, 2005

(65) Prior Publication Data

US 2006/0191966 A1 Aug. 31, 2006

(51) Int. Cl.
*A41D 27/22* (2006.01)

(52) U.S. Cl. ..... 223/87; 223/85; 223/92; 211/87.01; 378/208

(58) Field of Classification Search ..... 223/85, 223/86, 87, 88, 91, 95, 96, 97, 92; 211/85.3, 211/87.01, 88.04, 106.1, 118; 378/193, 204, 378/208; D6/315, 320, 323, 325, 326, 327, D6/328; D24/158
See application file for complete search history.

(56) References Cited

U.S. PATENT DOCUMENTS

| | | | | |
|---|---|---|---|---|
| 1,882,727 | A * | 10/1932 | Augustin | 223/88 |
| 2,620,072 | A * | 12/1952 | Searcy | 211/35 |
| 4,333,575 | A * | 6/1982 | Wong | 211/118 |
| 4,653,678 | A * | 3/1987 | Blanchard et al. | 223/85 |
| 5,002,245 | A * | 3/1991 | Hansen et al. | 248/99 |
| 6,006,964 | A * | 12/1999 | White | 223/85 |
| 6,036,062 | A * | 3/2000 | von Fabris auf Mayerhofen | 223/85 |
| D424,198 | S * | 5/2000 | Shepherd et al. | D24/158 |
| 6,098,933 | A * | 8/2000 | Stein | 248/99 |
| 6,176,400 | B1 * | 1/2001 | Lam | 223/120 |
| 6,450,378 | B1 * | 9/2002 | Miller | 224/275 |
| 6,454,145 | B1 * | 9/2002 | Russ | 223/85 |
| 2004/0200792 | A1 * | 10/2004 | Yang | 211/99 |

OTHER PUBLICATIONS

Apron Racks, www.1-800-medical.com,Jul. 1, 2002, YinPo Global Media.*

Combination Apron and Glove Holder, http://shieldingintl.com/racks/820.htm, Oct. 13, 2004, Shielding International.*

Dentsply Rinn, Protective Lead Aprons, http://rinncorp.com/catalog_aprons.shtml, Jan. 14, 2004.*

Ergonomic Products, Lead Apron Hanger, http://ergonomic-products.com, Mar. 11, 2004.*

(Continued)

*Primary Examiner*—Gary L. Welch
*Assistant Examiner*—Nathan E Durham
(74) *Attorney, Agent, or Firm*—Gregory IPL; Randy A. Gregory

(57) ABSTRACT

A radiation garment holder for mounting on a wall or other suitable surface. The holder has a central section with first and second clearance sections, first and second arms, and first and second shoulder support regions. The cantilevered clearance sections prevent radiation protection garments from contacting a support surface. The non-contact design reduces disease transmission between the radiation garment and a support surface, and reduces mechanical damage to the garment. The convex shoulder supports help extend the useful life of a radiation garment. The holder is nonporous and may readily be disinfected without degrading the material. The nonporous holder reduces the absorption of infectious agents, reduces the ability of the holder to support the growth of microorganisms or other antigenic materials, and reduces the risk of transferring unhealthful agents.

12 Claims, 3 Drawing Sheets

OTHER PUBLICATIONS

Oprax Medical International, Apron & Glove Racks, "Wolf's Tri-Rak", http://www.opraxmedical.com/Accessories/LeadProducts/Racks/, Nov. 13, 2003.*
RMXC Inc, Lead Apron & Glove Racks, http://rmxc.com/pa/pa4.htm, Jan. 11, 2003.*
DeBroeck Co., wallShoulders, www.wallshoulders.com.*
Apron Hanger, Clinical Information, www.dentsplymea.com.
Lead Apron Hanger, Ergonomic Products. www.ergonomic-products.com.
Apron Racks. www.1-800-medical.com.

* cited by examiner

RADIATION GARMENT HOLDER AND METHODS

TECHNICAL FIELD

The present invention relates to wall mountable holders for holding x-ray or other radiation protection garments.

BACKGROUND OF THE INVENTION

Radiation protection garments are expensive and heavy due to the layer or layers of radiation attenuating material included therein. The attenuating materials and covering are relatively susceptible to mechanical damage and fatigue, both of which shorten the garment's useful life.

Radiation garments are also a potential source of infection and contamination to the persons using them by transferring unhealthful infective or contaminating agents. Many radiation garments are used multiple times during a day by a number of different people. Throughout the day, these radiation garments are repeatedly removed from and then replaced onto a hanger or holder. This causes both exposure to unhealthful agents and mechanical wear and tear.

Prior wall mounted holders or hangers allow radiation garments to rub surfaces, such as a wall, near where they are hung. This causes additional mechanical wear to a radiation garment and can potentially act as a path for transmission of unhealthful agents of various types when a garment is used and reused repeatedly.

Many hangers and mounted holders have narrow contact or bearing regions on which a radiation garment hangs. These narrow contact regions can reduce the useful life of an expensive radiation garment by concentrating mechanical stresses on the shoulder regions of the heavy radiation garments. These stresses promote cracking, tearing and development of pinhole and other separations in a garment's shoulder regions.

Dentists and other medical professionals have become increasingly aware of the potential risks of spreading viruses such as the Human Immunodeficiency Viruses (which cause Acquired Immune Deficiency Syndromes), microorganisms and antigens which cause or contribute to diseases or autoimmune responses. There are also risks of contamination by chemicals or radiation emitting materials often present in hospitals and radiology clinics.

Many radiation garments, radiation garment hangers, and radiation garment holders have porous surfaces which can absorb viruses, microorganisms, chemicals or other health hazards. Many of the surfaces which contact radiation garments are porous and can also sorb (absorb, adsorb or both) to support and transmit unhealthy agents. Such exchanges can lead to the transmission of such agents between professional service providers and patients who come into contact with a radiation garment.

It is beneficial to have radiation garment holding apparatuses and related methods which attenuate paths of disease and other unhealthful agent transmission, are easily cleaned and disinfected, and extend the useful life of expensive radiation garments.

BRIEF DESCRIPTION OF THE DRAWINGS

Preferred forms or embodiments of the inventions are explained and characterized herein, often with reference to the accompanying drawings. The drawings also serve as part of the disclosure of the inventions of the current application. Such drawings are briefly described below.

DETAILED DESCRIPTION OF PREFERRED EMBODIMENTS AND BEST MODES

Introductory Note

The readers of this document should understand that the embodiments described herein may rely on terminology used in any section of this document and other terms readily apparent from the drawings and language common therefor. This document is premised upon using one or more terms with one embodiment that may also apply to other embodiments for similar structures, functions, features and aspects of the invention. Wording used in the claims is also descriptive of the invention and the text of the claims is incorporated by reference into the description entirely in the form of the claims as originally filed. Terminology used with one, some or all embodiments may be used for describing and defining the technology and exclusive rights associated herewith.

General Issues

The apparatuses and methods according to the current inventions enhance the useful life of radiation garments and help prevent radiation garments from becoming paths of transmission for disease or other unhealthful agents.

In one preferred embodiment of the inventions, the holder apparatus is advantageously embodied as a fabricated or molded one-piece radiation garment holder. The one-piece radiation garment holder, holds a radiation garment so that the garment does not come into contact with any surface other than the radiation garment holder. The preferred mode shown also reduces mechanical stresses to which the radiation garment is exposed.

In other embodiments of the inventions, a radiation garment holder may be constructed having more than one part. These alternative embodiments provide many of the advantages of the one-piece construction and configuration shown and described herein.

Central or Mounting Section of Holder

Figure 1:
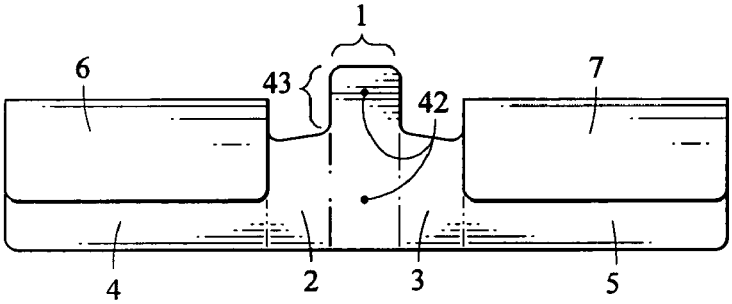
FIG. 1 is a front elevation view of a radiation garment holder in accordance with one preferred embodiment of the inventions.

FIG. 1 shows a preferred one-piece radiation garment holder 40 according to the inventions. As shown, garment holder 40 includes a central or mounting section 1 having at least one contact surface on its back face 19. In this embodiment the entire back face 19 serves as the contact surface for a planar mounting surface. Curvilinear contact surfaces are also possible according to other forms of the inventions. One or more holes or other openings 42 are advantageously provided for receiving mounts, such as fasteners 14 (FIG. 7) which, as shown, pass through the openings within the central section 1. Alternative mounts may also be suitable or operational.

The central section 1 also preferably includes an extension or tab 43 (FIG. 1). Central section tab 43 extends upwardly from a suitable joint or joinder. The illustrated is a curved integral bend 89 or other suitable connection between the central section and the first and second extension sections 90 discussed below.

FIG. 1 shows a preferred one-piece radiation garment holder 40 with a central section 1 having an upward tab extension 43. The added height of the mounting section 1 associated with the upward extension or tab 43 provides for improved mounting resistance to overturning forces. Such overturning or other forces may dislodge the holder 40 from the support structure upon which it is mounted.

This improved resistance to dislodgement is due to the higher elevation of the center section and the greater spacing between the mounting fastener apertures 42 at which the mounting section can be fastened to the supporting structure. This is a significant attribute because the radiation garments are generally quite heavy and the invention seeks to provide enough clearance to prevent contact with a wall or other support. Increased clearance causes increased forces as the amount of extension 91 increases.

The central mounting section has at least one contact surface on its back or rear face 19 which comes into direct contact against the mounting or support surface 47. The lower part or parts of the mounting section rear face are more resistive to compressive stresses produced when overturning forces are applied by the garment's weight or by incidental contact by people.

Figure 7:
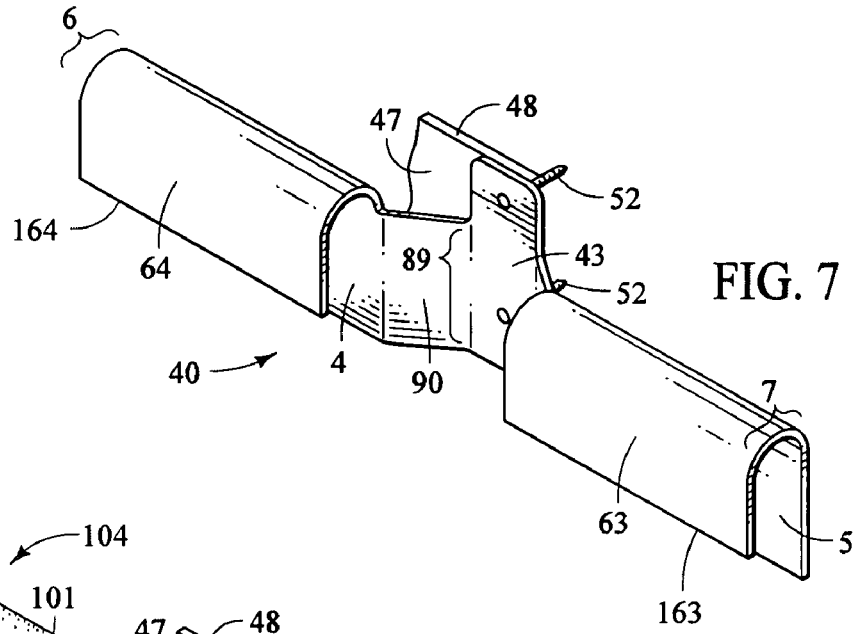
FIG. 7 is a perspective view of the radiation garment holder of FIG. 1 mounted to a supporting structure with fasteners.

As shown, the contact surface includes most or all of the entire rear face 19 of the central mounting section. Alternatively, the rear face of the central mounting section may have selected portions (not shown) that act as one or more contact surfaces or contact areas which engage the face of support surface 47 of a support structure 48 (FIG. 7). The support structure may include a wall, door panel, column or other upstanding support surface 47. The support structure may also include any additional structural members (not shown) which are under the wall board, door panel or other material on the outer face of the supporting structure.

The central mounting section preferably includes at least one, or more preferably, two or more mounting features. As shown, two holes or other openings 42 are provided for receiving fasteners 14 (FIG. 7). Alternatively, the mounting section may include projections which press into a wall, clips or other features which may supplement or replace the removable fasteners 14.

Cantilevered Extension or Clearance Sections

The extension and clearance sections 90 extend from the central section 1. The extension sections 90 are advantageously constructed in the form of cantilevered extensions. These cantilevered extensions support other more distal portions of the garment holder.

Figure 6:
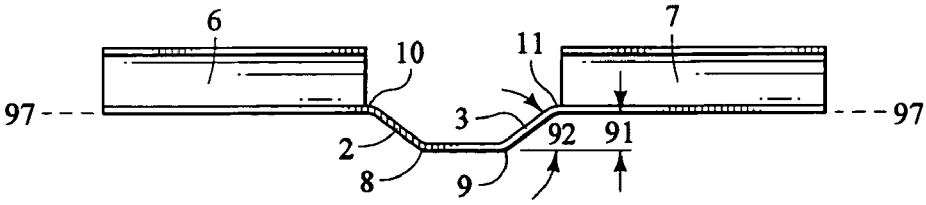
FIG. 6 is a bottom view of the radiation garment holder of FIG. 1.
Figure 5:
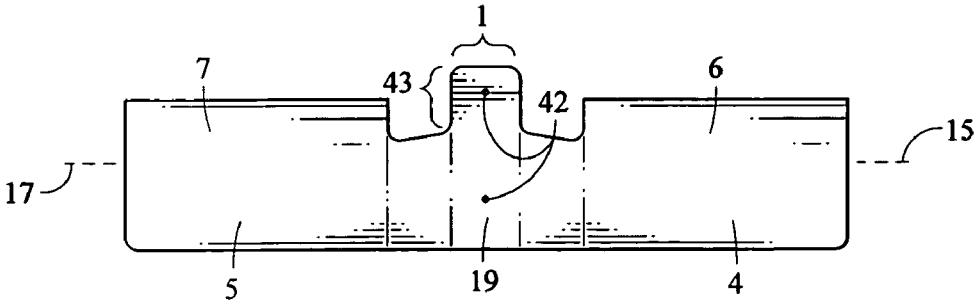
FIG. 5 is a rear elevation view of the radiation garment holder of FIG. 1.

The extension sections 90 have an extension distance 91 (FIG. 6). The extension distance may vary as desired to provide different extension amounts. The orientation angle of the extension sections relative to the central section 1 can also vary widely as desired to accommodate for common or very particular garment holder requirements. As shown, the orientation angle is about 30° of arc. Many other orientations are possible. A suitable range is from about 15° of arc to about 90° of arc, more preferably 20° to 70° of arc.

Extending from opposite side edges of central section 1 are first and second clearance sections 2 and 3 which are individual extension or clearance sections 90. The clearance sections have first or proximate bends 8 and 10 or other suitable proximate connections. The more distal portions of the clearance sections have distal connections, such as in the form of second or distal bends 9 and 11.

Extending respectively from the first and second clearance or extension sections 2 and 3, at the distal bends 9 and 11, are first and second arms 4 and 5, discussed more below.

Advantages or Benefits of the Extension Clearance Sections

Figure 4:
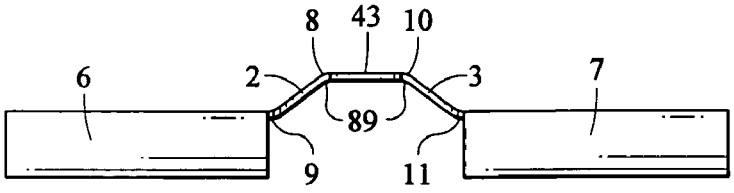
FIG. 4 is a top view of the radiation garment holder of FIG. 1.
Figure 2:
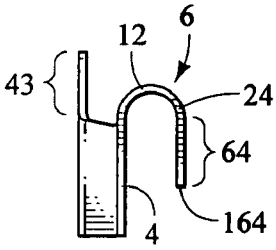
FIG. 2 is a left end view of the radiation garment holder of FIG. 1.
Figure 3:
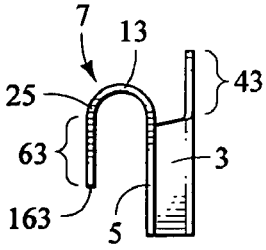
FIG. 3 is a right end view of the radiation garment holder of FIG. 1.

A radiation garment having a longer useful life and a reduction in the transmission of disease are advantages of the inventions. In part, this is provided by the first and second clearance sections 2 and 3, and their respective bends 8 and 9 and 10 and 11, (see FIG. 4). The clearance sections 2 and 3 position arms 4 and 5 away from the surface on which the holder is mounted 23 (see FIG. 7) so a radiation garment 20 hung on the holder (see FIGS. 7 and 8) does not come into contact with the supporting surface 47.

This physical separation between a radiation garment 20 and the supporting vertical surface 47 prevents mechanical wear caused by rubbing the radiation garment against a supporting surface 47. It also prevents the transfer of viruses, microorganisms, and other antigenic material between a radiation garment 20 and its supporting surface 47. Elimination of this path of disease transmission prevent disease causing agents from being transferred from the supporting surface 47 to the garment, individuals handling the radiation garment and patients who wear the garment.

A reduction in radiation garment wear and transmission of disease is specifically affected by the proximate bends 8 and 10 and length of clearance sections 2 and 3. Both of these parameters may vary. A preferred clearance section distal spacing 91 is 2-4 inches, although others are also workable depending on the application.

First and Second Arms

The invention has first and second arms 4 and 5 which are joined to the extension sections 2 and 3 near distal ends thereof. The connection may be various joints, bends, and other joinders. The arms extend in opposite directions from each other and the central mounting section. The arms have orientations 97 (FIG. 6) relative to their supporting extension sections which may vary. As shown, the arms extend outwardly from the central section, preferably in diametrically opposing orientations, although other orientations may also be satisfactory. The arms 4 and 5 extend in different directions outward from proximate ends at the joinder with the extension or clearance sections. The arms are advantageously directed outwardly in opposing directions, more preferably, along a common plane.

First and Second Shoulder Supports

The first and second arms 4 and 5 are provided with shoulder supports 6 and 7, respectively. This is preferably done by attaching the shoulder sections to the upper part of arms 4 and 5. In the embodiment shown, this is accomplished by shaping or molding the shoulder supports with arms 4 and 5. Even more preferably, the shoulders 6 and 7 are integral extensions from the arms 4 and 5 which are preferably convex upon the upper exterior surfaces thereof.

FIG. 7 in particular illustrates that the shoulders 6 and 7 curve away from or outwardly from the contact surface to help provide additional clearance 91. The shoulder support sections are also advantageously provided with depending sections 64 and 63, respectively. These depending extensions serve to provide added strength and facilitate vertical hanging of a garment hung thereon. The bottom edges of depending sections 64 and 63 are labeled 164 and 163.

Advantages or Benefits Of The Shoulder Supports

The useful life of a radiation garment is further extended by the radiation garment holder shoulder supports 6 and 7 (see, FIGS. 1-8). The preferred smooth curves 12 and 13 which define the shape of the respective shoulder supports 6 and 7 provide an increased surface area on which to distribute the weight of the radiation garment. This reduces the stress on the respective shoulder regions 21 and 22 of a radiation garment hung on the holder 20 (see FIGS. 7 and 8). This reduces the risk of tears, cracks, pin holes or other separations. Such separations leak radiation and require removal of the garment from use.

Figure 8:
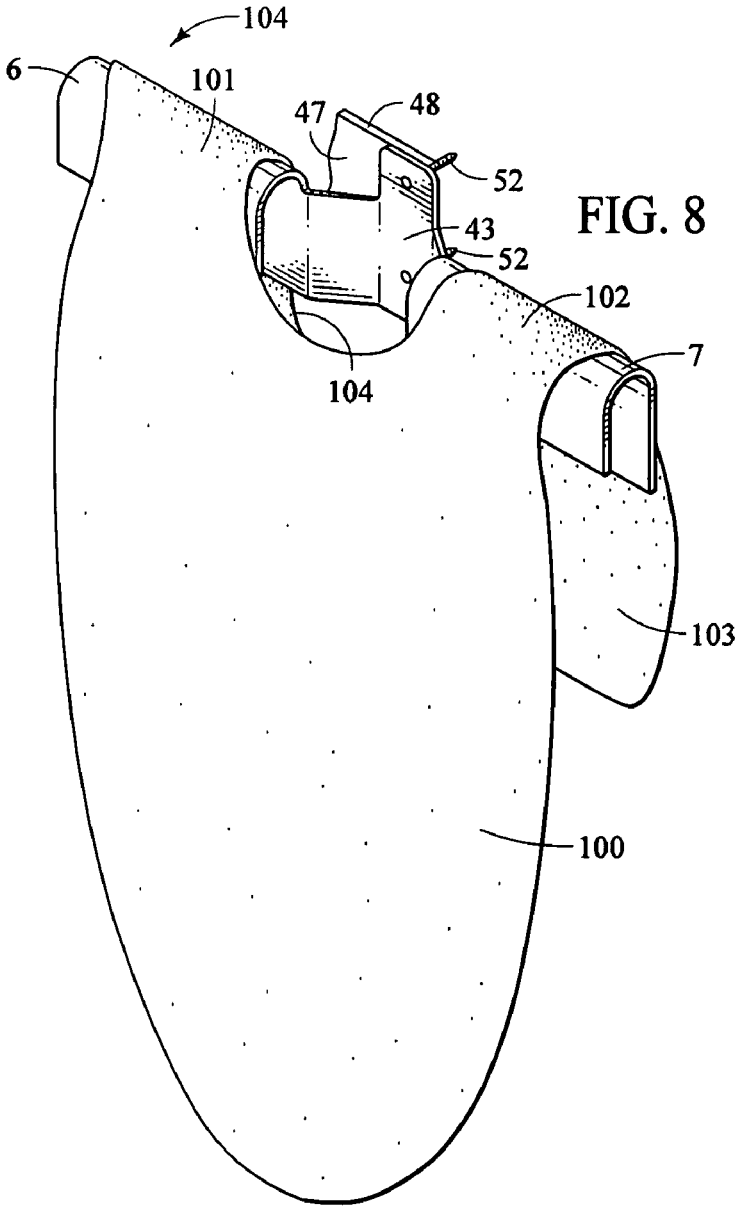
FIG. 8 is similar to FIG. 7 with a radiation garment on the holder.

The separation between the shoulder supports 6 and 7 also reduces stress on a radiation garment by allowing the garment to hang smoothly, helping to prevent folding of the garment while it hangs on the holder (FIG. 8). The separation of the shoulder supports 6 and 7 of the holder, correspond with the separation of the shoulder regions of the radiation garment 21 and 22 (see FIGS. 7 and 8).

In the embodiment shown in FIGS. 1-8, the respective shoulder supports 6 and 7 are formed from material extending from the top edges 15 and 17 (FIG. 5) of the respective arms 6 and 7. The shoulder supports preferably are formed in the shape of a smooth curve 12 and 13 until the front edges 24 and 25 of the respective shoulder supports 6 and 7 are approximately parallel with the plane of their respective arms 4 and 5 (see, FIGS. 2 and 3). The wider the respective smooth curves 12 and 13, the greater the support area of the respective shoulder supports 6 and 7. As shown, the curved convex shoulder supports 12 and 13 are approximately semi-cylindrical.

Garment Support Blanks

Figure 9:
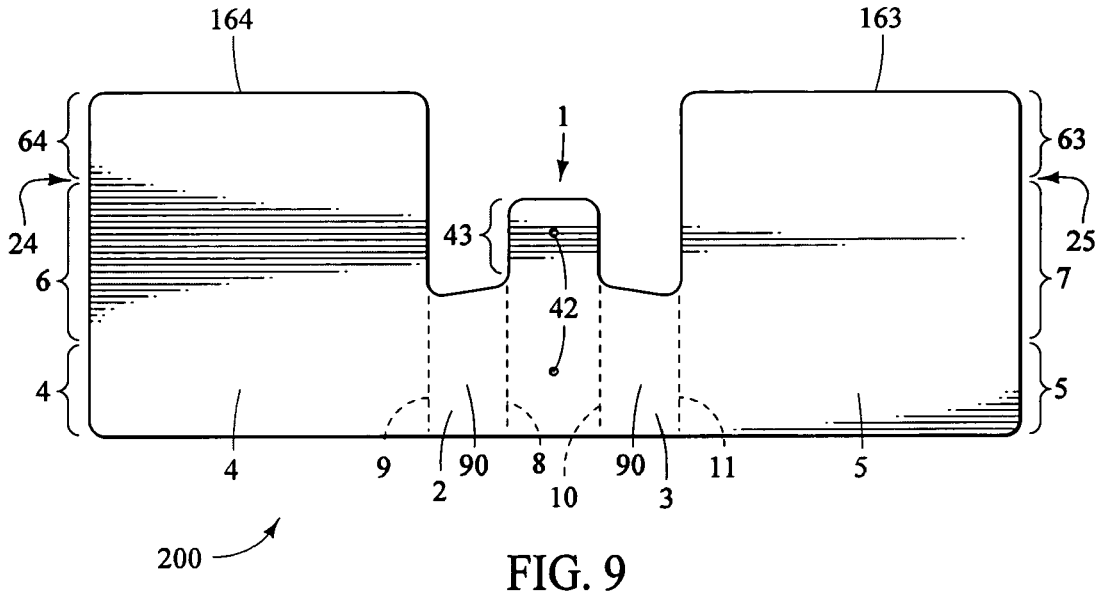
FIG. 9 is a plan view of a flat blank which may be used to make the holder of FIG. 1. The blank is shown in the flat condition before any bending or other shaping has been performed.

In the illustrated embodiment of the holder, it is formed from a planar form blank 200 shown in FIG. 9. The material is preferably capable of being bent at either room temperature or by thermal forming.

The flat blank 200 has been labeled with reference numbers the same as those discussed above to enable seeing various sections or parts which are shaped into the garment hanger of FIGS. 1-8. No additional description is needed.

The flat blank 200 is shaped into the configuration shown in FIGS. 1-8 using conventional forming techniques known in the arts applicable to the material or materials of construction used.

Preferred Materials of Construction

The material selected for forming a radiation garment holder according to the inventions is of important consideration. This is true especially relative to transmission of unhealthful agents and maintenance, cleaning and disinfection. For example, the preferred materials provide a nonporous surface upon the exterior, and to a lesser degree a non-porous material in the interior structure. In most cases the material will be uniform, but layered materials may provide suitable constructions.

These attributes are offered by certain polymers, such as many of the acrylics which provide a uniform non-porous outer surface and internal structure. Also possible may be stainless steels, such as medical grade stainless steels. Other materials providing the indicated properties may also be suitable. It may still further be possible to provide a nonporous surface by coating a base material of suitable type using a coating which provides a relatively thick and nonporous surface layer.

In one embodiment of the inventions the material used is a commercially available nonporous acrylic sold by E. I. Du Pont De Nemours and Company under the trademark CORIAN. Other companies sell similar commercially available plastics, one other such material is the acrylic sold under the trademark DEGAMENT by Röhm GMBH and Co., KG of Germany and its subsidiary Röhm America. A preferred thickness is 0.25 inch.

The choice of a nonporous material is preferred to reduce the sorption and transmission of disease causing agents or other unhealthful agents. Nonporous materials, such as the mentioned commercial grades of acrylics, do not absorb viruses, microorganisms, or other antigenic materials and they do not support the growth of microorganisms. They are also resistant to adsorbtion of unhealthful agents.

Non-porous surfaces are more easily disinfected than porous surfaces. Porous surfaces can absorb and hide viruses, microorganisms, antigens, or other pathogenic materials. The material selected should be capable of being disinfected with a variety of suitable commonly available disinfectants. The cleaning agent and disinfectants used preferably are selected to clean and disinfect without causing the material to degrade significantly.

Multi-piece Construction

In some embodiments of the holder, the construction may consist of two or more separate parts which are assembled. For instance, there may be a separate mounting piece which may be attached to the more than one contact surface 19 on the back of the central section 1 to provide additional physical separation or shape configuration between the shoulder supports 6 and 7 and the supporting surface 47. The separate mounting piece may be bonded, attached with fasteners, or both bonded and attached with fasteners to the back side of the central section 1. Other alternative configurations are also possible.

Methods of Making

Some preferred methods of manufacturing embodiments of the inventions, such as shown in FIGS. 1-8, have the following steps. Select a suitable nonporous disinfectant resistant sheet material. Cut the sheet material to the desired form blank configuration, such as shown in FIG. 9. The blank 200 has a central region, first and second clearance regions, first and second arms, and first and second shoulder support material regions. Heat the form blank to a temperature within a required temperature range, which depends upon the material selected, so the material becomes sufficiently pliable to be formable. The appropriate temperature range will vary dependent upon the material chosen. Impart respective first and second bends in the respective clearance regions of the form blank. Then, or simultaneously, form the respective shoulder supports by curving the shoulder support material. If the radiation garment is intended to be mounted on a supporting surface with fasteners, the openings 42 may be drilled or thermally formed in the central section for receiving fasteners at several suitable stages in making the garment holder.

Manners of Using

The radiation attenuating garment holder of FIGS. 1-8 is preferably used by first mounting the holder to a wall, door or other upright surface with adequate structural support to prevent dislodgement.

The holder is then cleaned and disinfected in preparation to receive a garment thereon. The garment is also advantageously cleaned and disinfected and then hung on the holder so as to not contact the adjacent wall or other support surface.

FIGS. 7 and 8 show the garment holder in unladen and laden conditions. Radiation garment 100 is sometimes referred to as a poncho style. It has a right shoulder area 101 and a left shoulder area 102. The right and left shoulder areas connection to respective right 104 and left 103 back panels.

A person moving or desiring to use the radiation garment carefully removes the garment from the holder, again being careful not to contact the adjacent walls or other sources of contaminants. The garment is then used as is well-known and replaced after use in the fashion indicated above.

Interpretation Note

The invention has been described in language directed to the current embodiments shown and described with regard to various structural and methodological features. The scope of protection as defined by the claims is not intended to be necessarily limited to the specific features shown and described. Other forms and equivalents for implementing the inventions can be made without departing from the scope of concepts properly protected hereby.

I claim:

1. An apparatus for hanging a radiation garment from a wall at a desired mounting position, comprising:

a central section having at least one contact surface adapted for mounting upon said wall when said apparatus is mounted to said wall at said desired mounting position;

first and second clearance sections attached to opposing sides of the central section, said first and second clearance sections extending outwardly from said at least one contact surface to provide clearances from the at least one contact surface and said wall when the apparatus is mounted on said wall;

first and second arms respectively connected to the first and second clearance sections, said first and second arms extending in different directions in cantilevered configurations;

first and second shoulder supports being integrally connected to the respective first and second arms, said first and second arms and respective first and second shoulder supports forming integral panels in which the first and second arms extend upwardly and have respective first and second shoulder supports that are smoothly curved panels which are convex along upper surfaces thereof and concave upon lower surfaces thereof; wherein said first and second shoulder supports receive shoulder portions of said radiation garment thereon when said radiation garment is supported upon the apparatus.

2. An apparatus according to claim 1 further comprising first and second depending portions extending downwardly along an outer portions of said first and second shoulder supports.

3. An apparatus according to claim 1 wherein the apparatus is made from a single panel formed into said apparatus.

4. An apparatus according to claim 1 wherein the apparatus is made from a single flat panel formed into said apparatus.

5. An apparatus according to claim 1 wherein the apparatus is an integrated unit.

6. An apparatus according to claim 1 wherein the apparatus is a molded integrated unit.

7. An apparatus according to claim 1 wherein the apparatus is made from a non-porous material to prevent or reduce the sorption of unhealthful agents and to allow disinfection of the apparatus.

8. An apparatus according to claim 1 wherein further comprising at least one extension tab which extends from said central section.

9. An apparatus according to claim 1 wherein said first and second clearance sections have joinders with the central section and respective first and second arms which have bend angles in the range of 20 to 70 degrees.

10. A method for producing a radiation garment holder, comprising:

selecting a flat panel of suitable material;

cutting the flat panel into a blank having the following features:

a central section;

first and second clearance sections attached to the central section and in opposing relative relationship;

first and second arms portions respectively connected to the first and second clearance sections, said first and second arms extending in opposing directions;

first and second shoulder support portions integrally connected to and extending along said first and second arm portions;

first and second depending portions integrally connected to and extending along said first and second shoulder support portions;

bending first and second proximate bends at proximate joinders of the respective first and second clearance sections to said first and second arms;

bending first and second distal bends at distal joinders of the respective first and second arm portions to the first and second clearance sections;

forming the first shoulder portion of the first arm into an upwardly convex shape to form the first shoulder support;

forming the second shoulder portion of the second arm into an upwardly convex shape to form the second shoulder support;

wherein said steps of bending the proximal and distal bends have binders with the central section and respective first and second arms which have bend angles in the range of 20 to 70 degrees.

11. A method according to claim 10 and further comprising forming first and second depending portions which extend respectively from outer parts of the first and second shoulder portions.

12. A method according to claim 10 wherein said step of cutting the flat panel into a blank includes providing at least one extension tab which adjoins the central portion.

* * * * *